US006675389B1

(12) United States Patent
Kublick

(10) Patent No.: US 6,675,389 B1
(45) Date of Patent: Jan. 13, 2004

(54) GARMENT WITH ZIPPERS ENABLING EASY ACCESS

(76) Inventor: Louise Marie Kublick, 42 Deerglen Terrace, Aurora, Ontario (CA), L4G 6Y2

( * ) Notice: Subject to any disclaimer, the term of this patent is extended or adjusted under 35 U.S.C. 154(b) by 0 days.

(21) Appl. No.: 10/217,777

(22) Filed: Aug. 14, 2002

(51) Int. Cl.[7] ..... B63C 11/04

(52) U.S. Cl. ..... 2/2.17; 2/128; 2/2.15

(58) Field of Search ..... 2/2.15, 2.17, 69, 2/82, 96, 125, 126, 128, 270, 227, 275, 457, 458, 456, 77, 93, 85, 113, 114, 115, 228, 230

(56) References Cited

U.S. PATENT DOCUMENTS 302,901 A * 8/1884 Fenne ..... 2/114
782,819 A * 2/1905 Bikle ..... 2/75
818,351 A * 4/1906 Clark ..... 2/114
1,233,156 A * 7/1917 Zies ..... 2/114
1,489,046 A * 4/1924 Thompson ..... 2/114
2,291,861 A * 8/1942 Astrove ..... 2/80
2,475,058 A * 7/1949 Sheard ..... 2/93
2,622,248 A * 12/1952 Schaye ..... 2/80
2,738,512 A * 3/1956 Winer ..... 2/80
3,763,498 A * 10/1973 Rector ..... 2/2.15
3,771,169 A * 11/1973 Edmund ..... 2/2.17
4,068,315 A * 1/1978 Rainville ..... 2/114
4,258,440 A * 3/1981 McGowan ..... 2/114
4,422,186 A * 12/1983 Loney ..... 2/114
4,494,248 A * 1/1985 Holder ..... 2/69
4,587,671 A * 5/1986 Rodriguez et al. ..... 2/69
4,608,719 A * 9/1986 Lunt ..... 2/114
4,663,781 A * 5/1987 Krosby ..... 2/86
4,737,995 A * 4/1988 Wiley ..... 2/114
4,914,756 A * 4/1990 Grassick ..... 2/227
5,062,159 A * 11/1991 Jakub ..... 2/114
5,084,914 A * 2/1992 Hesch ..... 2/79
5,097,535 A * 3/1992 Dye et al. ..... 2/69
5,159,716 A * 11/1992 Takata ..... 2/2.16
5,315,716 A * 5/1994 Baum ..... 2/227
5,359,731 A * 11/1994 Cavalier ..... 2/46
D362,742 S * 10/1995 Bergman ..... D2/745
5,553,322 A * 9/1996 Cebo-Johnson ..... 2/69
5,553,323 A * 9/1996 Chou et al. ..... 2/114
5,603,123 A * 2/1997 Chupa ..... 2/275
5,621,917 A * 4/1997 Howsden ..... 2/111
5,768,703 A * 6/1998 Machado et al. ..... 2/2.15
5,802,611 A * 9/1998 McKenzie et al. ..... 2/69
5,864,888 A * 2/1999 Archer ..... 2/227
5,887,279 A * 3/1999 Elting et al. ..... 2/69
5,940,879 A * 8/1999 Whitehouse ..... 2/2.17
5,978,960 A * 11/1999 Wrightman ..... 2/2.15
6,049,913 A * 4/2000 Harrigan, Jr. ..... 2/227
6,108,815 A * 8/2000 Majerfeld ..... 2/71
6,119,270 A * 9/2000 Chou ..... 2/108
6,154,883 A * 12/2000 Spann et al. ..... 2/69
6,305,027 B2 * 10/2001 Chou ..... 2/227
6,477,712 B1 * 11/2002 Jones ..... 2/69

* cited by examiner

*Primary Examiner*—John J. Calvert
*Assistant Examiner*—Alissa L Hoey
(74) *Attorney, Agent, or Firm*—Anthony Asquith & Co.

(57) ABSTRACT

A wetsuit comprises separate jacket and pants. The arm-sleeves and leg-sleeves have zippers running lengthwise, whereby the sleeves can be completely opened up. A wearer, e.g. a physically-disadvantaged child, can simply be laid upon the opened-out garment, by an assistant, who can then very easily wrap the garments around the limbs of the child, and can do up the zippers.

4 Claims, 9 Drawing Sheets

GARMENT WITH ZIPPERS ENABLING EASY ACCESS

This invention relates to garments, especially combinations or suits of garments, and to easing the difficulty with which such garments can be fitted to the wearer. The invention is advantageous especially where the wearer is a child, and has to be helped into the garment, and especially where the wearer is a physically-disadvantaged child.

Although the invention may be applied to the design of other types of garments, the invention will be described herein mainly as it relates to wetsuits.

BACKGROUND TO THE INVENTION

A wetsuit can be difficult even for a strong healthy wearer to put on. One of the difficulties with putting on a wetsuit lies in inserting the arms into the tubes that form the arm-sleeves, and in inserting the legs into the tubes that form the leg-sleeves. Even a non-disadvantaged person finds that it can take a good deal of muscular strength to force the hand and arm into and along the tight-fitting tube that comprises the sleeve. Also, the material from which wetsuits are made is generally foam rubber, which has a high coefficient of friction. The combination of tightness and high friction can leave even a normally-functioning person momentarily exhausted from the muscular effort of forcing the arms into the sleeves, and the legs into the pants, of a typical conventional wetsuit.

The therapeutic benefits of swimming are well known, and these benefits are no less applicable to disadvantaged children (and adults) than to normally-functioning persons. Indeed, swimming is often favoured, as being the activity in which a physical handicap is the least restrictive.

For a physically-disadvantaged person, especially a disadvantaged child, the effort needed to force the arms and legs into the sleeves and pants can be simply too much. Even with an adult caregiver assisting with the heavy pushing, it can be a major task for a disadvantaged child to get into a wetsuit. The task of getting a cold wet child out of a saturated wetsuit also carries its own difficulties.

The invention is aimed at providing a design of e.g. a wetsuit, in which the adult assistant finds it very simple to assemble the (helpless) child into the wetsuit.

GENERAL FEATURES OF THE INVENTION

The invention lies generally in providing a garment as an integrated unitary piece of fabric material. That is to say, the garment can be fabricated by stitching together separate pieces of fabric, but the finished manufactured garment is effectively a single piece. The garment has zippers, whereby the garment can be opened out. As will be described, the zippers are arranged in such a manner that the garment, and especially the sleeves (both arm-sleeves and leg-sleeves of the garment can be so completely opened out that the wearer can simply be laid upon the opened out garment. Then, an assistant can very easily wrap the garment around the arms and/or legs of the wearer, and the assistant can then easily do up the zippers. Removing the wearer from the garment is also easy to accomplish, at least in the case of a small physically-disadvantaged child, in that the assistant, having released the zippers, and laid the garment flat, can then simply lift the child up and out of the garment.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 2:
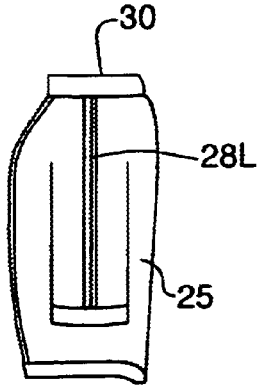
FIG. 2 is a side view of the jacket of FIG. 1.
Figure 1:
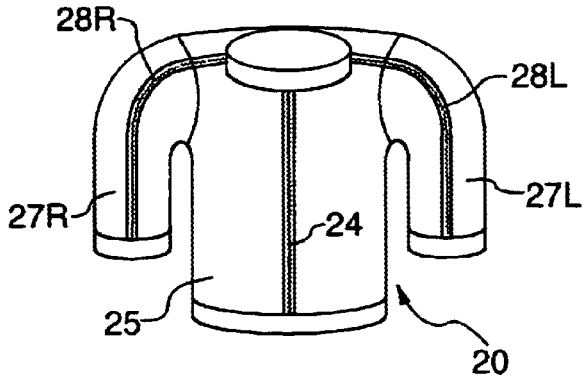
FIG. 1 is a front view of a wetsuit jacket for a physically-disadvantaged child, which embodies the invention.

The wetsuit garments as shown in the drawings comprises a jacket 20 and pants 23. The jacket 20 is shown in FIGS. 1,2 in the configuration when worn by a person. The jacket has a seam 24 down the front of the bodice 25, which can be opened and closed by means of a front-zipper 26. The sleeves 27L,27R also have sleeve-seams which can be opened and closed by means of respective arm-zippers 28L,28R. The sleeve-seams run from the arm-cuffs 29L,29R at the ends of the (long or short) sleeves all the way to the neckband 30. The sleeves can be completely laid open, when the arm-zippers 28L,28R are opened.

When the arm-zippers 28L,28R are opened, the jacket 20 can be opened out, and laid out flat on a surface such as a tabletop, with the inside surfaces of the garment now facing upwards. It is emphasized that, in this opened-out configuration of the jacket (FIG. 3), the left and right sleeves 27L,27R are fully laid open, as is the bodice 25.

In the opened-out configuration of the jacket, a person (e.g a disadvantaged child) may lay, or be laid, on their back, on top of the opened-out jacket. Then, an assistant can very quickly and easily wrap the left and right sleeves 27L,27R around the respective arms of the person, and can wrap the bodice 25 around the torso of the person. Then, it is again a very quick and simple matter for the assistant to do up the front-zipper 26 and the arm-zippers 28L,28R.

The child or person to whom the jacket 20 is being applied is not required to exert muscular effort, but can simply lie still, while this is being done. The person may be handicapped to the extent of having virtually no capability to push their arms into tight sleeves, but that makes no difference to the ease with which the assistant can apply the garment to the person, and can then engage and draw the zippers.

Figure 4:
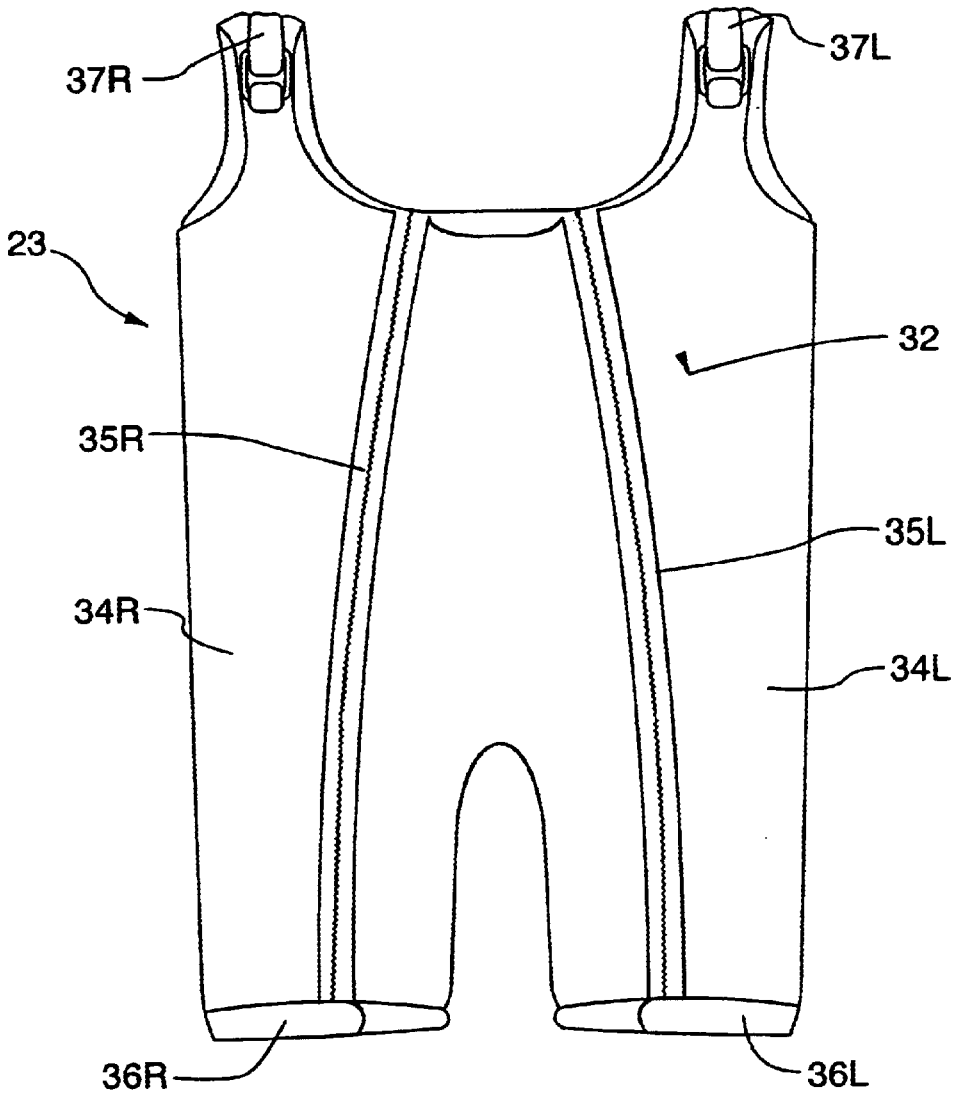
FIG. 4 is a front view of a wetsuit pants garment, which embodies the invention.
Figure 5:
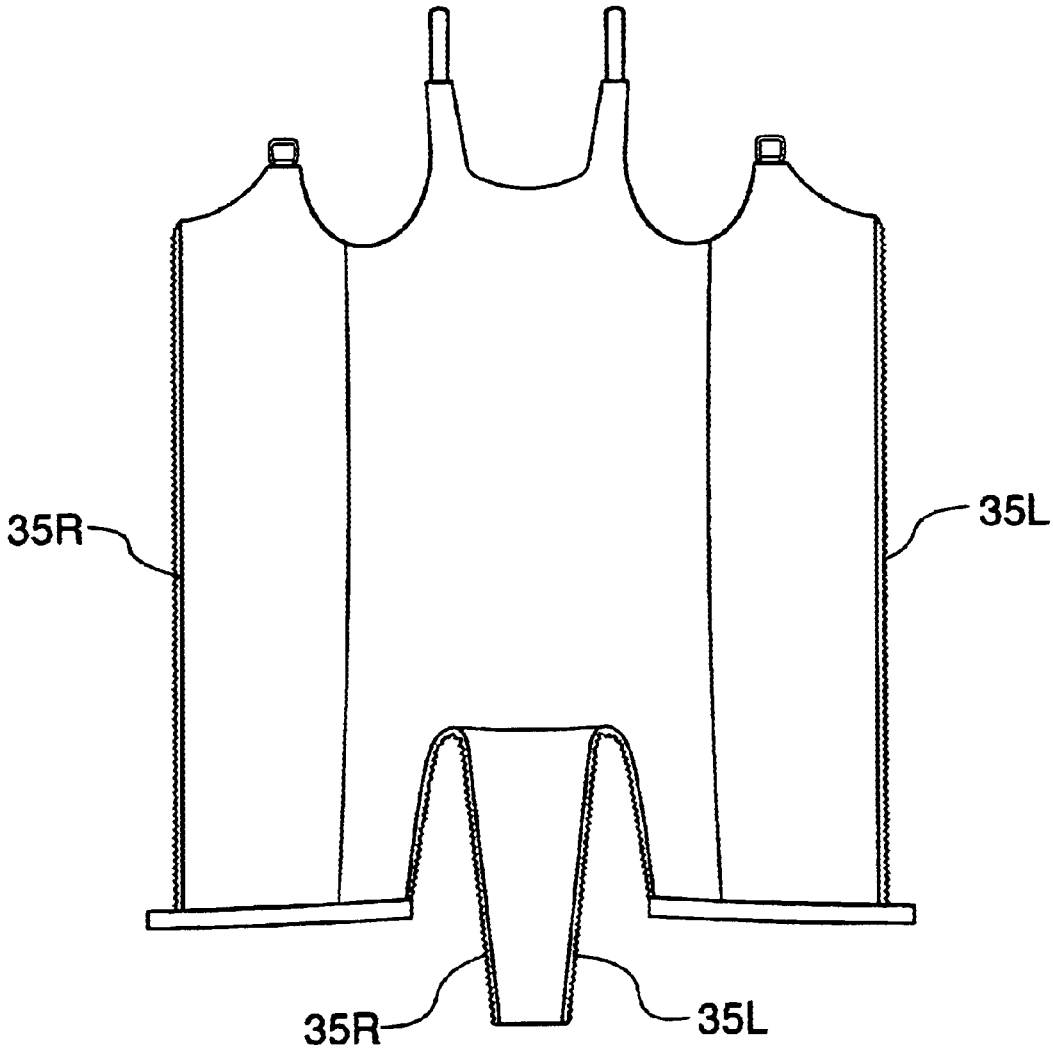
FIG. 5 is a diagrammatic plan view of the pants garment of FIG. 4, shown opened up and laid out flat.

FIGS. 4 and 5 show a garment 23 in the form of pants. FIG. 4 shows the pants in the configuration as worn by a person. The garment extends well above the waist area of the person. The upper-portion 32 of the pants, above the waist, basically comprises suspenders, which pass over the shoulders of the person, although this upper-portion serves also as an at-least-partial bodice to encircle the torso.

The pants 23 have two seams, which extend down the front of the leg-sleeves 34L,34R. These seams are closed by pant-zippers 35L,35R, which extend all the way from the top of the partial bodice, down to the leg-cuffs 36L,36R. (It may be noted that there is no separate fly-zipper, as is commonly found in pants-type garments.)

Again, when the pant-zippers 35L,35R have been opened, the garment can be fully opened out and laid flat on a tabletop, with the inside surfaces uppermost. FIG. 5 shows the configuration of the pants 23 when the pant-zippers 35L,35R are opened out. Again, the (disadvantaged) person can lie, on their back, on top of the opened-out pants, and again it is an easy matter for the assistant to wrap the leg-sleeves around the respective legs of the person, and then to engage and draw the pant-zippers.

Figure 3:
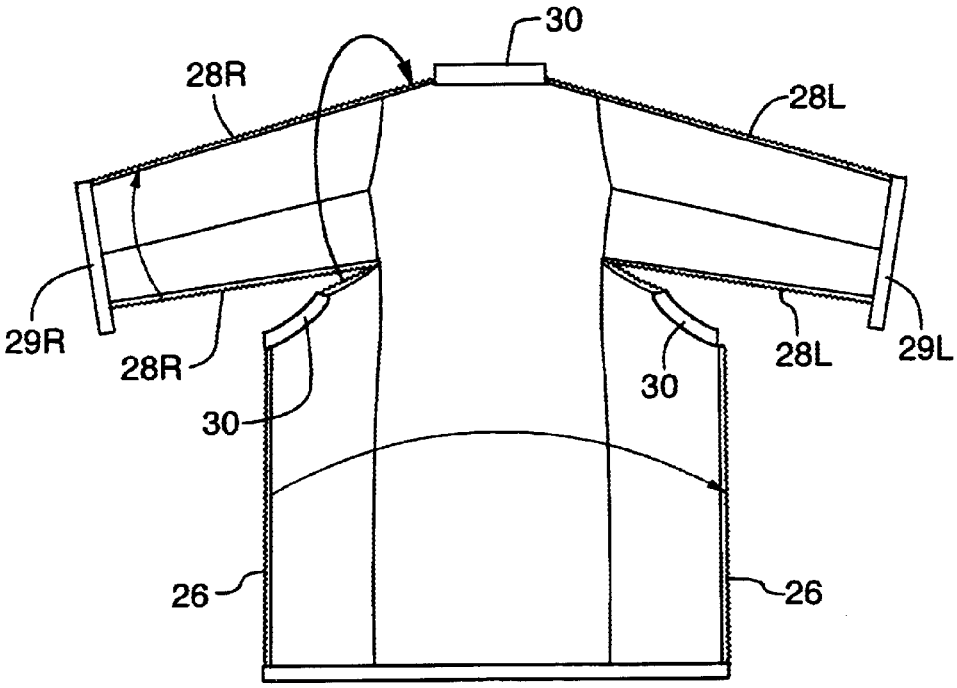
FIG. 3 is a diagrammatic plan view of the jacket of FIG. 1, shown opened up and laid out flat.

FIGS. 3 and 5 are views showing the jacket 20 and pants 23 garments in the fully-opened, laid-out-flat, condition. FIG. 5 is a mainly true indication as to how the pants garment 23 looks in this condition. However, FIG. 3 is somewhat diagrammatic. In the case of the jacket garment 20, even when the arm-zippers 28L,28R and front-zipper 26 are fully opened out, the material of the jacket 20 still cannot be quite fully laid flat. Rather, when the jacket is fully opened out, some of the material of the jacket, especially at least around the underarm area, remains in a rucked and folded state. Thus, for the sake of ease of illustration in FIG. 5, some areas of the material and seams and zippers are shown in a foreshortened state.

Figure 3A:
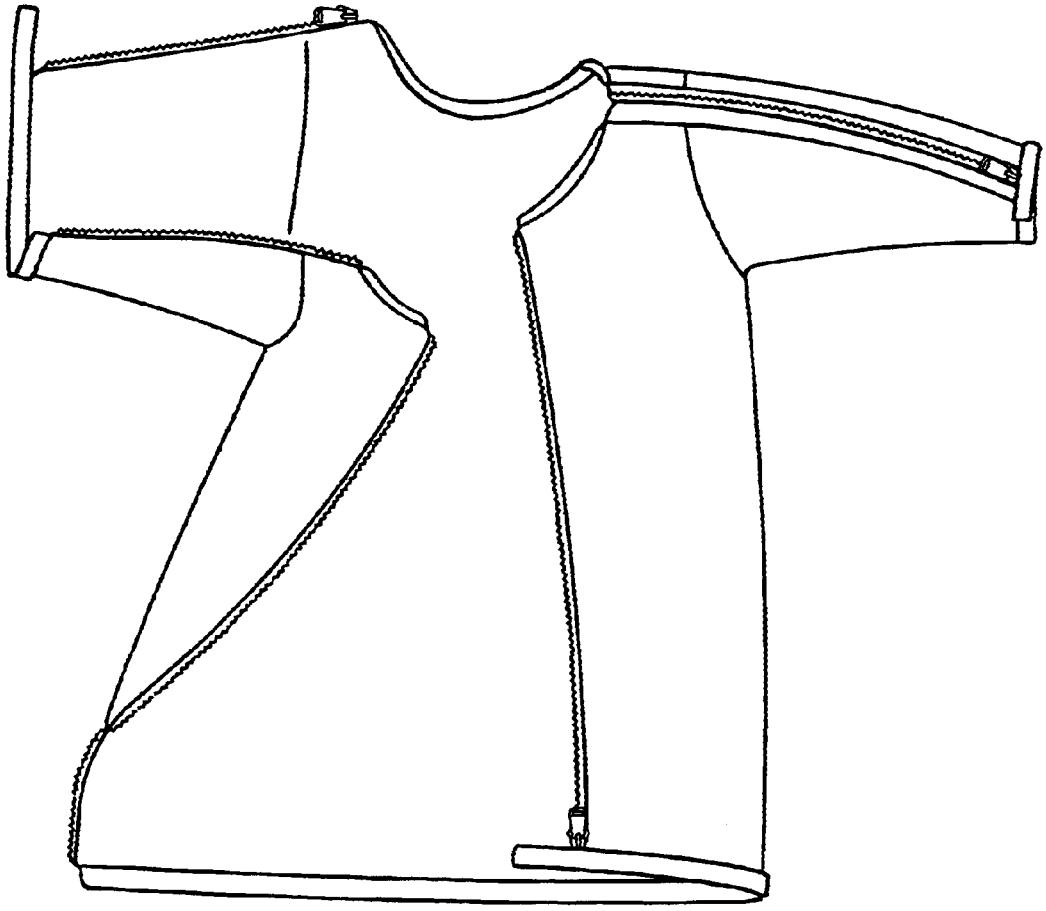
FIG. 3A is a plan view of the jacket, shown in a partially opened-out condition.
Figure 3B:
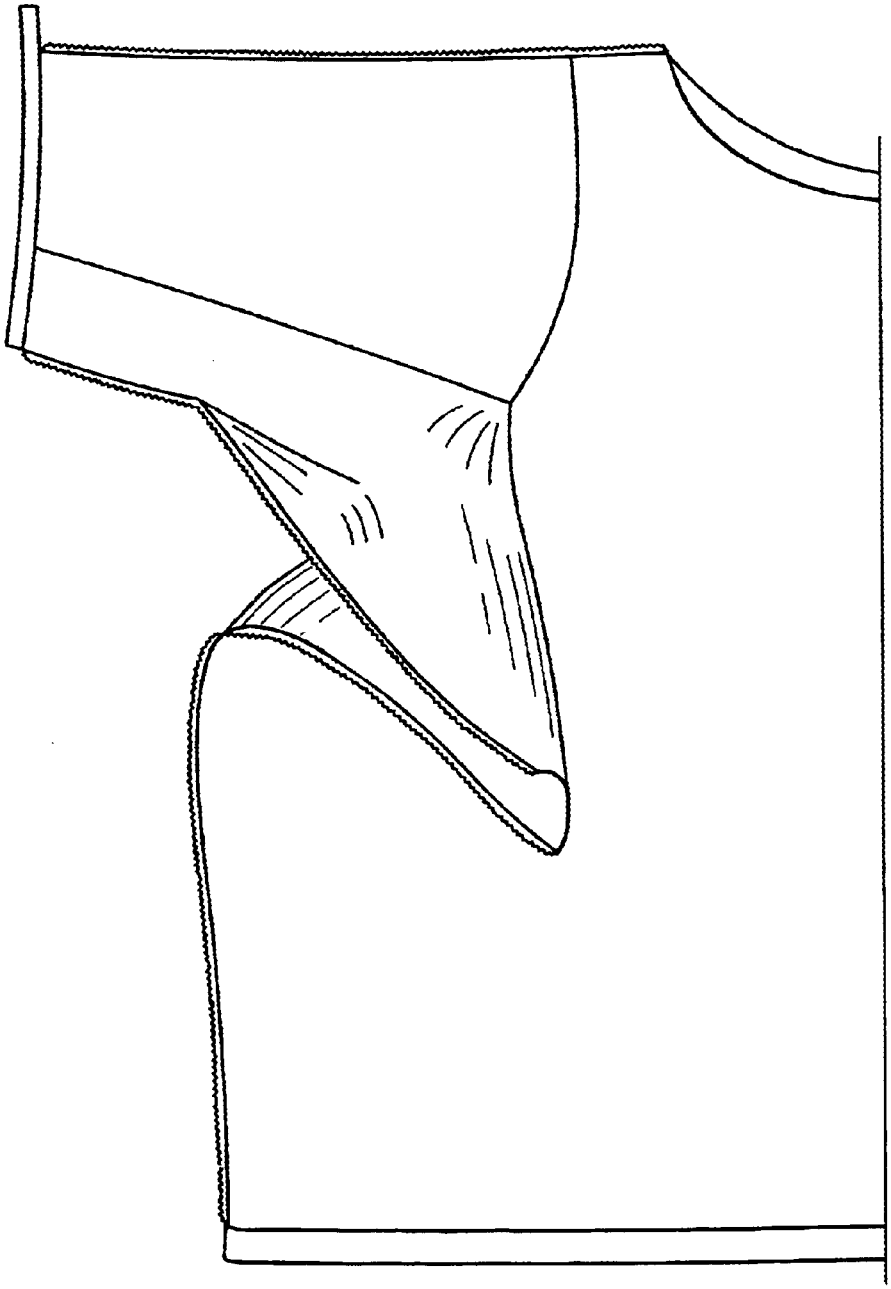
FIG. 3B is a plan view of the jacket, showing how the fully opened and laid-out garment may be rucked and folded.

FIG. 3A illustrates how the jacket actually looks, in a partially opened out condition. FIG. 3B shows how the jacket actually looks in the fully opened out condition, and shows the rucked and folded underarm area. It will be understood from these views that, although the underarm area cannot be fully laid flat, nevertheless the bodice and sleeves can be laid flat to a sufficient extent that the wearer can, without difficulty, be placed upon the laid-out jacket. Also, the sleeves and the bodice can, without any difficulty at all, both be wrapped around the arms and body of the wearer, and the zippers engaged and done up.

Figure 5A:
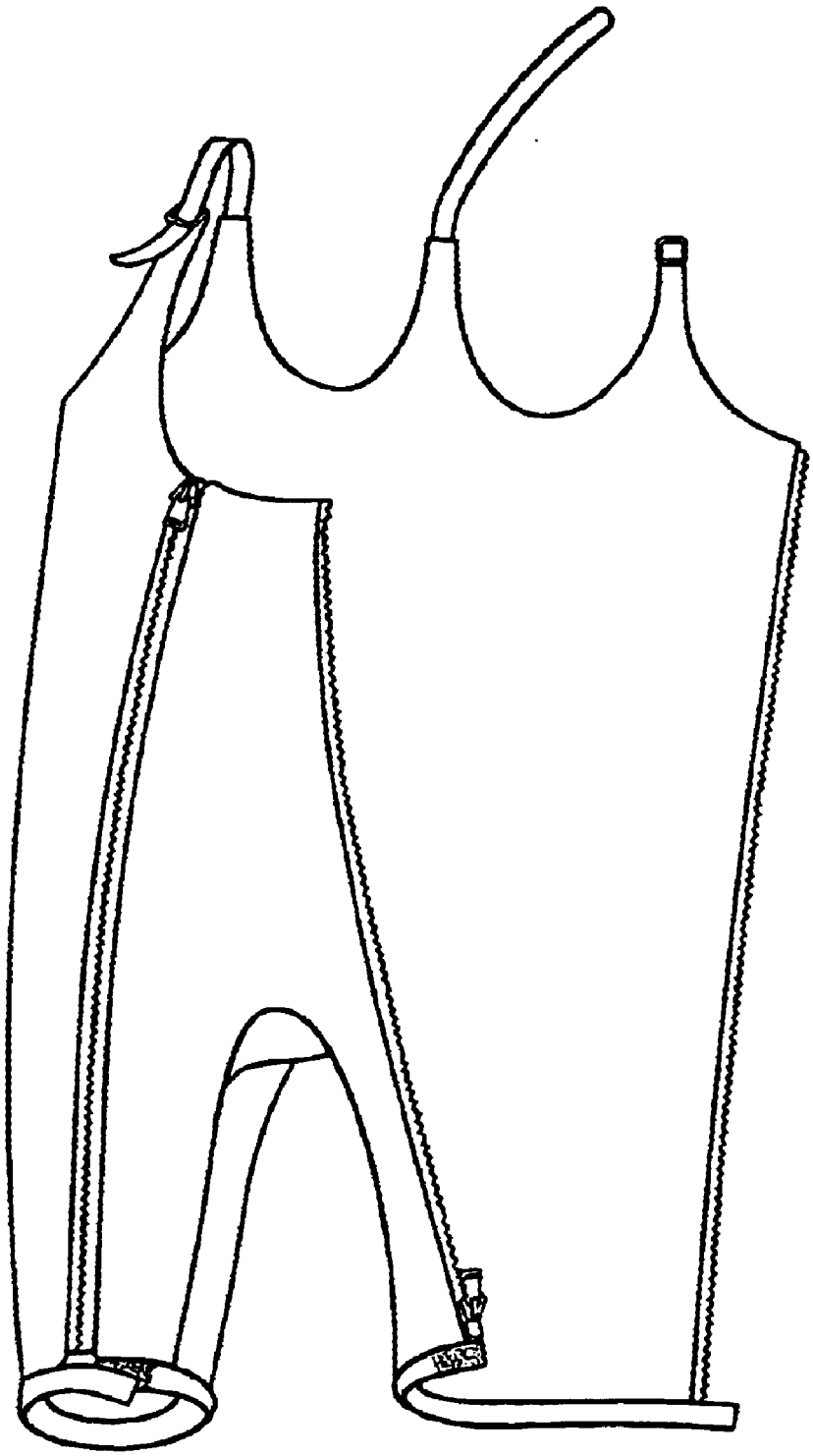
FIG. 5A is a plan view of the pants, shown in a partially opened-out condition.
Figure 5B:
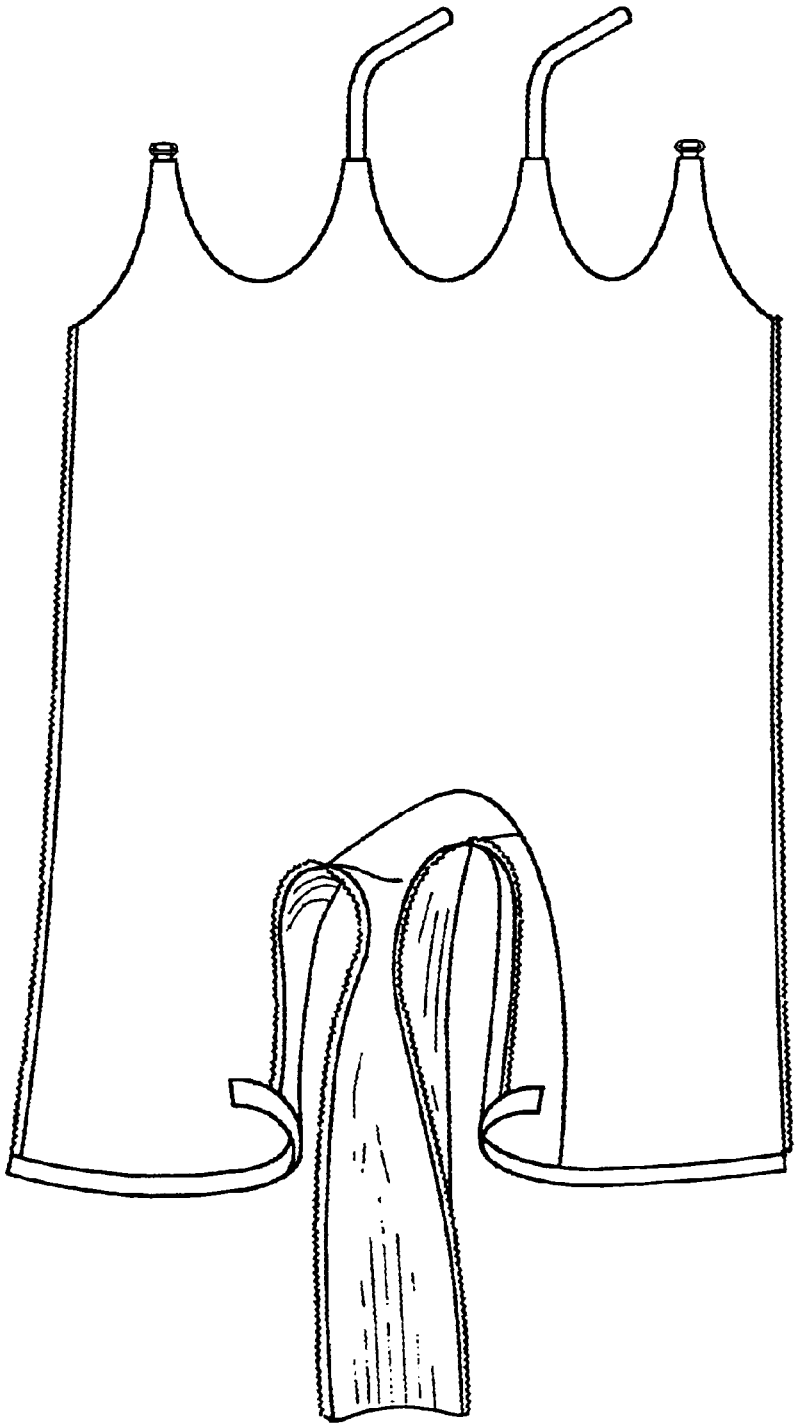
FIG. 5B is a plan view of the pants, showing how the fully-opened and laid-out garment may be rucked and folded.

Similarly, FIG. 5A shows how the pants garment actually looks, in a partially opened out condition. FIG. 5B shows how the pants garment actually looks in the fully opened out condition. Again, the (gusseted) crotch area of the pants is rucked and folded, but it will be appreciated that the rucks and folds in this area do not interfere with the fact that the physically-disadvantaged child can, without difficulty, be laid upon the opened-out garment. Then, the leg-sleeves and upper portion of the garment can, without any difficulty at all, both be wrapped around the legs and body of the child, and the zippers engaged and done up.

Figure 6:
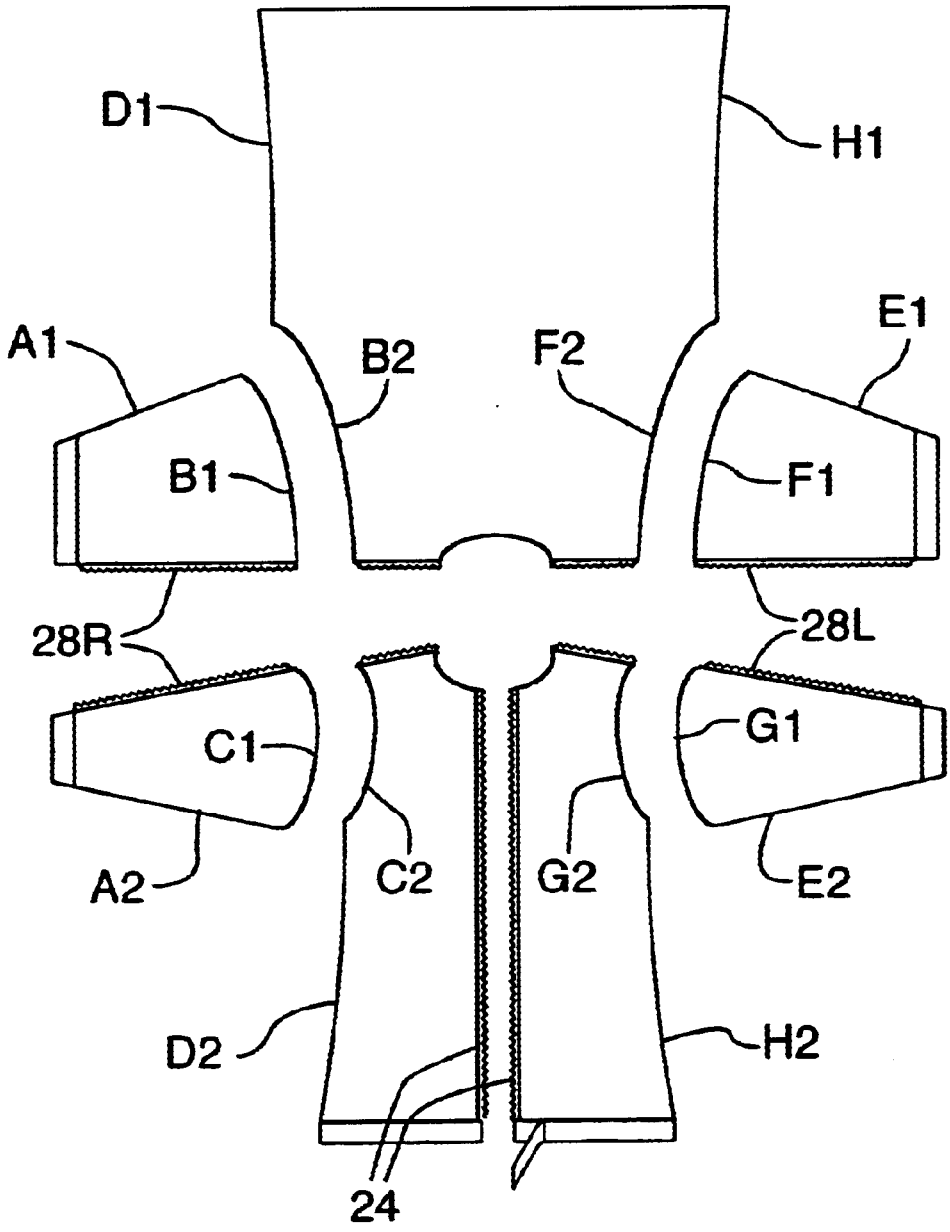
FIG. 6 is a view of the component parts of the jacket of FIG. 1.

FIG. 6 shows the pieces of fabric material that are stitched together, to make up the jacket garment 20. The manner in which the seams are stitched is indicated by the reference markers: thus, edge A1 is stitched to edge A2, B1 to B2, and so on.

Figure 7:
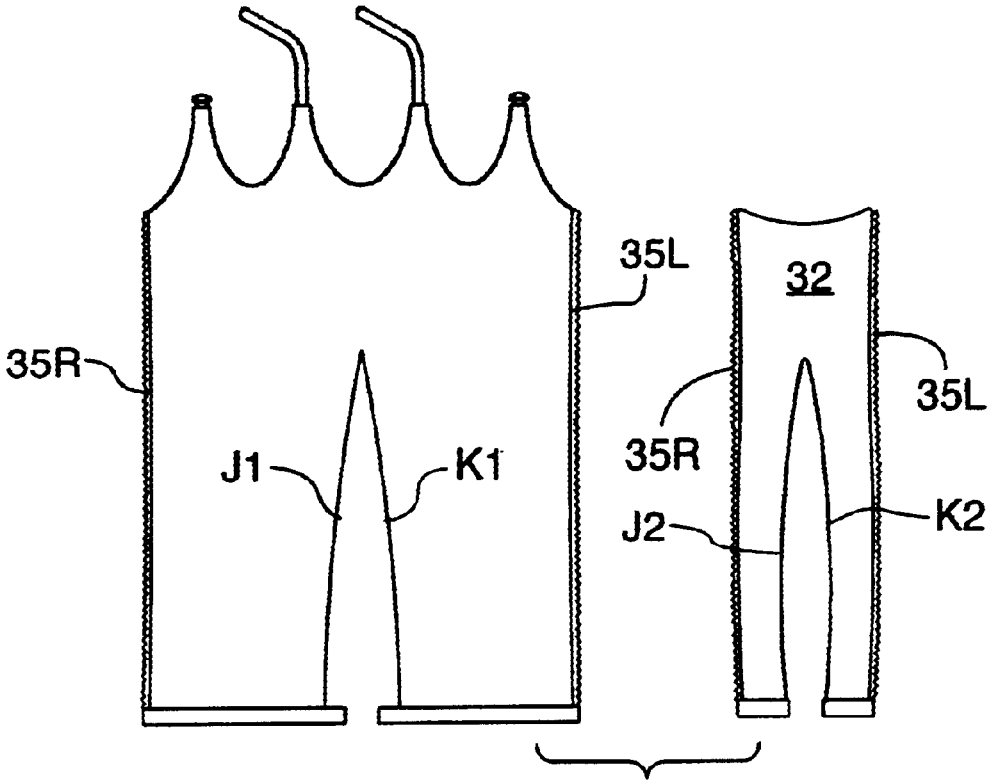
FIG. 7 is a view of the component parts of the pants of FIG. 4.

FIG. 7 shows the pieces of material that are stitched together to make up the pants garment 23.

In the case of the pants 23, the upper-portion 32 defines suspenders, which serve to define arm-holes of the pants garment. A strap-and-buckle arrangement 37L,37R is used to enable the arm-hole to be broken open, whereby the opened-out garment can be laid completely flat, as shown. However, in an alternative construction, the over-shoulder portion of the arm-hole is formed by stitching the pieces together, whereby the arm-hole cannot be opened out. It is recognised that, while it can be impossibly difficult for disadvantaged children to push their arms through a long tight sleeve, it is often a simple matter for children to place their arm through a loose arm-hole.

The provision of a disconnectable strap-and-buckle in the over-the-shoulder area means that the suspenders can be adjusted as to the length of the trousers, which is important in that children can change height very quickly.

Figure 8:
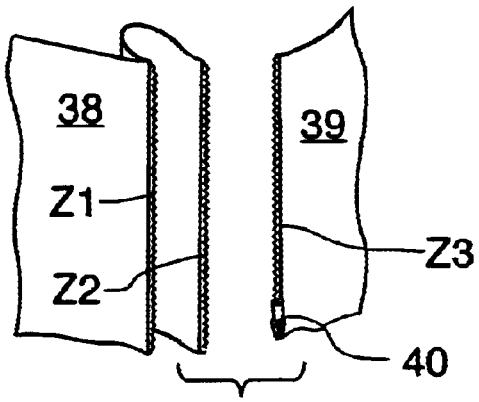
FIG. 8 is a view showing a double-zipper seam.

The adjustability of the garments is also enhanced by the provision of double-zippers. This is illustrated in FIG. 8. Thus, where a zipper connects the left edge of a flap 38 of material to the right edge of another flap 39 of material, the left edge can be provided with two lines, Z1 and Z2, of zipper teeth, instead of the usual one line. When the child is small, the first line Z1 of teeth on the left edge 38 are zipped to the line Z3 of teeth on the right edge 39; when the child is larger, the second line Z2 of teeth on the left edge are zipped to the line Z3 of teeth on the right edge.

The zippers as used in the illustrated garments are of the kind wherein the left and right lines of teeth come fully apart, in that the zip-slider 40 remains with one line Z3 of teeth, but can be disengaged from the other lines Z1,Z2 of teeth. This type of zipper is known as a separating zipper, and one of the ends of such a zipper is termed the separating end. The separating end may be placed at whichever end is convenient; the designer may prefer to arrange the zippers so that, when done up, the zipper tags are not at the neck ends of the zippers, where the tags might possibly irritate the wearer's neck.

The material of a wetsuit (usually neoprene) is cellular and porous, and the material is not watertight, as such. A wetsuit performs its function of inhibiting heat loss from the body by the fact that the pores retain stationary pockets of water next to the wearer's skin. It is these stationary pockets of water that provide the main insulation. Cold water is prevented from moving over the skin, i.e between the skin and the material of the wetsuit, by the snug fit of the material against the skin.

Thus, the insulative qualities of the wetsuit are not dependent upon the neckband 30 and cuffs 29L,29R,36L,36R making a completely watertight seal onto the wearer's body. In the present invention, the neckband is made up of a number of partial bands, attached to the various openable pieces, and these partial bands together form the complete encirclement.

It is recognised that it would be difficult to make such an encirclement watertight, but it is also recognised that the performance of the wetsuit is not compromised by the resulting encirclement being not quite watertight. In the garments illustrated herein, the bands and partial bands that make up the neckbands and cuffs can be joined to each other by e.g. Velcro (TM) fasteners, which are not watertight per se.

It is contemplated that the jacket and pants could both be provided in one single garment. The sleeve-zippers would then be the same as in the separate jacket, but the front zipper of the separate jacket would be replaced by the two pant-zippers as shown in the case of the separate pants garment. Upon opening up all the zippers, the whole garment would be completely opened out, and laid out flat on a tabletop for the wearer to lay down upon, and for the assistant then to wrap the sleeves around the wearer's limbs, and do up all the zippers. However, such a single garment would be difficult to make adjustable as to the wearer's height. Since snugness of fit is important to the performance of a wetsuit, and because snugness can be more readily assured when the jacket and pants are separate garments, the separate garments option, as illustrated, is preferred.

The manner of arranging the zippers in garments as described herein is advantageously applicable to wetsuits, because wetsuits are particularly difficult for disadvantaged persons, especially children, to put on. They have to fit snugly, and have to be in direct touching contact with the body, all over the body. Also the fabric material from which wetsuits are generally made has a high coefficient of sliding friction. However, it should be understood that the use of the zipper arrangement as described is not limited to children, nor to physically-disadvantaged persons.

It will also be understood that other types of garments, for example snowsuits, also may benefit from having the zippers arranged in the manner as described. Children's snowsuits can be snug-fitting, though of course not to the tightness with which wetsuits are traditionally designed. The problem with snowsuits is usually simply one of time, in the case where twenty young children all have to be put into snowsuits, by the adult assistant, to go out and play, at the same time—and then all have to be taken out of the snowsuits fifteen minutes later.

The zipper arrangements if the invention may also be applied in the case of dry-suits. As distinct from a wetsuit, a dry-suit keeps water out by the fact that the suit is waterproof, and is sealed tightly to the body at the cuffs etc. Dry-suits can be tight-fitting, and made of rubber, and can be difficult for a physically-disadvantaged person to put on.

It may be noted that the benefits arising from the zipper arrangement as described herein arise mainly in the case where the zippers are to be done up by an assistant. It is hardly practical for the wearers themselves to do up the zippers, though such is not to be ruled out as an impossibility.

The terms arm-cuffs and leg-cuffs as used herein should be construed as applicable whether the arm-sleeves or leg-sleeves of the garment are long (ending at the wrist and ankle) or short (ending at the elbow and knee).

What is claimed is:

1. A wetsuit garment, including a jacket, which is structurally suitable for wearing by a person who is unable to assist in the act of donning the wetsuit, wherein:

the jacket is so structured as to fit around the arms and torso of the person, and to leave the person's legs free;

the jacket includes sleeves for fitting around the arms of the person, and the garment has a neckband, and has left and right snug-fitting cuffs at the ends of the sleeves;

each sleeve combines the following characteristics:

the sleeve includes a sleeve-wall of fabric material, and the sleeve has an openable seam along which the sleeve can be opened and closed;

the seam includes a back edge of the sleeve-wall and a front edge of the sleeve wall, which can be physically separated apart and joined together by means of an operable seam-fastener;

the seam-fastener includes a back fastener element associated with the back edge and a front fastener element associated with the front edge;

the seam-fastener is operable between an open condition of the seam and a closed condition;

the closed condition of the openable seam is a condition in which, the seam-fastener being closed, the back and front edges lie closed together, and the sleeve-wall defines a circumferentially-complete tube, which can encase the said one limb of the person;

in the closed condition of the openable seam, the sleeve then has a tubular axis, and the sleeve-wall has an inside surface and an outside surface;

the openable seam extends lengthwise relative to the said tubular axis of the sleeve;

the open condition is a condition of the openable seam in which, the seam-fastener being open, and the garment being placed upon a table, the sleeve-wall can lie open, with the outside surface towards the table, and the inside surface facing upwards;

the openable seam extends from the neckband to the respective cuff, and the garment is so arranged that the whole sleeve, including the neckband and the cuff, lie completely opened out when the seam is in the open condition;

the nature of the open condition of the openable seam is such that the person's arm can be placed, by a placement of the arm down onto the table, against the upwards-facing inside surface of the sleeve-wall, and the sleeve-wall can then be wrapped around the arm, by bringing the back and front edges of the sleeve-wall together, and the seam-fastener can then be operated to the said closed condition of the seam;

the fabric material is an elastomeric foam material, and the sleeve is arranged to be tight-fitting over the limb of the person, in the closed condition of the seam.

2. Garment of claim 1, wherein the wetsuit garment includes a pant, having left and right pant-leg-sleeves, adapted to fit the legs of the person.

3. Garment of claim 2, wherein:

the pants garment has a top edge, and has left and right leg-cuffs at the ends of the leg-sleeves;

the left and right pant-leg-sleeves include left and right leg-zippers extend from the top edge to the respective leg-cuffs, and are so arranged that the pant-leg-sleeves and the top edge can be completely opened out upon the leg-zippers being opened.

4. Garment of claim 1, wherein the seam-fastener comprises an arm-zipper.

* * * * *